US005249379A

United States Patent [19]

Baker et al.

[11] Patent Number: 5,249,379

[45] Date of Patent: Oct. 5, 1993

[54] MOUNTING STRUCTURE FOR THE LINEAR ACTUATORS OF A TRENCHING APPARATUS

[75] Inventors: John L. Baker; Dannie R. Teel, both of Lubbock, Tex.

[73] Assignee: Eagle-Picher Industries, Inc., Cincinnati, Ohio

[21] Appl. No.: 945,100

[22] Filed: Sep. 15, 1992

[51] Int. Cl.[5] ..... E02F 5/06

[52] U.S. Cl. ..... 37/357; 37/347; 37/464

[58] Field of Search ..... 37/191 A, 191 R, 192 R, 37/192 A, 83, 86, 87, 88, 89, 90, 84, 85, 80 R; 414/686, 688, 692, 710, 715, 718

[56] References Cited

U.S. PATENT DOCUMENTS

| | | | |
|---|---|---|---|
| 3,388,487 | 6/1968 | Peck | 37/90 |
| 4,164,082 | 8/1979 | Watson | 37/83 |
| 4,843,742 | 7/1989 | Camelleri . | |
| 4,971,157 | 11/1990 | Bollinger et al. | 37/80 R X |
| 5,104,260 | 4/1992 | Trevisani | 37/191 A X |
| 5,112,161 | 5/1992 | Trevisani | 37/192 A X |
| 5,189,819 | 3/1993 | Holloway et al. | 37/191 A X |

*Primary Examiner*—Randolph A. Reese
*Assistant Examiner*—J. Russell McBee
*Attorney, Agent, or Firm*—Wood, Herron & Evans

[57] ABSTRACT

A trenching apparatus comprises a boom assembly mounted on a support base which carries a digger arm operative to form a trench alongside the support base following a trench line. The boom assembly includes an inner boom, pivotally connected to a manipulator head which carries the digger arm, and an outer boom pivotally anchored to the support base. The inner boom is slidable within the outer boom by operation of a pair of linear actuators each having an actuator housing mounted to the outer boom, and an actuator rod connected to the end of the inner boom. Mounting structure is provided for securing the linear actuators to the boom assembly which permits at least limited movement of such actuators relative to the boom assembly, and which substantially dampens vibrations and reduces bending and lateral forces transmitted through the boom assembly, so that damage and wear to the linear actuators is substantially reduced.

10 Claims, 2 Drawing Sheets

MOUNTING STRUCTURE FOR THE LINEAR ACTUATORS OF A TRENCHING APPARATUS

FIELD OF THE INVENTION

This invention relates to apparatus for forming trenches, and, more particularly, to a trenching apparatus having a boom assembly carrying a digger arm capable of digging a longitudinally extending trench suitable for the formation of an in-ground retaining wall at an excavation site wherein linear actuators which manipulate the boom assembly and digger arm are protected from damage during operation.

BACKGROUND OF THE INVENTION

The erection of above-ground structures often requires the formation of in-ground retaining walls for use as a load-bearing foundation or as a barrier to prevent the collapse of soil into the excavated area. Where such excavations are made adjacent an existing structure, a retaining wall along the excavation line adjacent the existing structure is necessary to resist soil pressures established beneath the adjoining structure. If no retaining wall is formed, the soil beneath the adjoining structure can collapse outwardly into the excavation and/or damage the existing structure. In addition to retention of soil, retaining walls of this type are often constructed to block the flow of ground water into the excavated area.

A number of methods have been employed to form retaining walls around an excavation site or adjacent structures which adjoin such site. One method has been to employ piles formed of wood or steel which are driven along the excavation line to form the retaining wall. Alternatively, a row of bored holes are formed along the excavation line which receive reinforced concrete piles to form the retaining wall. Both of these methods produce retaining walls which are not watertight, and which may require substantial horizontal strengthening to maintain the desired alignment along the excavation line.

Trenching apparatus such as disclosed in U.S. Pat. No. 4,843,742 to Camelleri have been proposed as an alternative to the methods and apparatus of forming retaining walls mentioned above. In trenching apparatus of this type, a supporting base capable of being moved along an excavation line carries an elongated trench digger arm supported on one side thereof by a boom assembly. The support base is drivingly connected to skids or track assemblies of the type employed in conventional bulldozers which are effective to move the support base and digger arm along the excavation line to form a trench of the desired depth. Concrete is poured into the trench immediately behind the moving trenching apparatus into which appropriate reinforcing bars are inserted so that an essentially continuously formed, reinforced concrete retaining wall is provided at the excavation site.

The trenching apparatus described in U.S. Pat. No. 4,843,742 includes a boom assembly having an inner boom which slides in and out of a outer boom by operation of linear actuators such as hydraulic or pneumatic extension cylinders. The housings of the linear actuators are carried by the outer boom, and their actuating rods are connected to the inner boom. The digger arm is pivotally connected to and suspended from the end of the inner boom, and the bottom of the outer boom is pivotally connected to the support base.

One problem with trenching apparatus of the type described in U.S. Pat. No. 4,843,742, particularly in digging deep trenches and/or in hard and rocky soils, involves damage to the linear actuators resulting from twisting, bending and vibration of the boom assembly during operation and manipulation of the digger arm. Not only does the boom assembly support the heavy weight of the digger arm at the end of the inner boom, but additional forces are exerted against this structure while digging a trench. Because the linear actuators in these apparatus are rigidly connected to the booms, they also twist, bend and vibrate along with the booms during the trenching operation. As a result of the stresses generated by this movement, the linear actuators can become damaged.

SUMMARY OF THE INVENTION

It is therefore among the objectives of this invention to provide a trenching apparatus having a boom assembly carrying a digger arm capable of digging a longitudinally extending trench along a trench line which substantially reduces the bending loads and vibration transmitted through the boom assembly to the linear actuators associated therewith during the manipulation of the digger arm and during the trench digging operation.

These objectives are accomplished in a trenching apparatus having a boom assembly mounted on a support base which carries a digger arm operative to form a trench alongside the support base following a trench line. The boom assembly includes an inner boom which is connected by a manipulator head to the digger arm, and an outer boom pivotally anchored to the support base. The inner boom is slidable within the outer boom by operation of a pair of linear actuators such as fluid actuated extension cylinders. Each linear actuator has an actuator housing mounted to the outer boom, and an actuating rod connected to the end of the inner boom. A manipulator head pivotally attaches to the end of the inner boom which carries the digger arm. In the course of manipulating the digger arm and while conducting a trenching operation, vibration and bending loads are transmitted to the linear actuators through the boom assembly. This invention is predicated on the concept of providing mounting structure for securing the linear actuators to the boom assembly which permits at least limited movement of such actuators relative to the boom assembly, and which substantially dampens vibrations transmitted through the boom assembly, so that damage and wear to the linear actuators is substantially reduced.

In the presently preferred embodiment, mounting structure for the actuator housing of the linear actuators is provided at two locations along the outer boom of the boom assembly. The upper portion of each linear actuator housing is connected to the upper portion of the outer boom by a pivot assembly which permits pivotal motion of the actuator housings relative to the outer boom about two mutually perpendicular axes of rotation. Such motion allows the actuator housings to move with the actuator rods, which are connected with the inner boom to the manipulator head, thus reducing the chances of bending of the actuator rods and/or damage to the internal seals within the actuator housing. In addition, a portion of the lower end of each actuator housing is attached to the lower end of the outer boom by a vibration dampening assembly. The vibration dampening assembly is effective to limit the pivotal motion allowed by the pivot assembly, and to at least partially dampen vibrations which would otherwise be transmitted from the boom assembly to the actuator housings.

Each pivot assembly comprises a clevis base having two outwardly projecting side walls. Each clevis base is pivotally mounted to the side of the outer boom by a pivot shaft in position to receive opposed journals carried by one of the linear actuator housings. These journals fit into notches located on the top edge of each side wall of the clevis base. A saddle shackle is positioned over each journal and bolted into each side wall, with each journal being free to rotate within the notch and shackle. The pivot assembly therefore permits each linear actuator to simultaneously rotate about the central longitudinal axes of the journals, which are coincident with one another, and the axis of the pivot shaft which mounts the clevis base which is perpendicular to the longitudinal axes of the journals.

The vibration dampening assembly associated with each linear actuator comprises a slotted support bracket bolted to and projecting laterally outwardly from the lower end of the outer boom. A saddle bracket, lined with resilient shock absorbing material, is suspended below the support bracket in position to receive and support the lower end of a linear actuator housing such that a space or gap is formed between the linear actuator housing and the bottom surface of the support bracket. A sliding pad provides frictional resistance to dampen vibrational motion of the linear actuator but allows lateral movement caused by bending and lateral forces. The sliding pad is located on top of the support bracket, and is slidably retained thereon by a retaining plate. The shank of at least two bolts passes through matching holes in the retaining plate and sliding pad, and through elongated slots formed in the support bracket, to retain such elements on the support bracket. The sliding pad and retaining plate are slidable along the support bracket, but such motion is limited by engagement of the shank of the mounting bolts with an edge of the elongated slots formed in the support bracket. The leading end of each bolt is attached by nuts to the saddle bracket, and the headed ends of each bolt rest atop the retaining plate. These bolts allow vertical adjustment of the saddle bracket with respect to the support bracket.

The vibration dampening assembly performs two functions. First, the resilient shock absorbing material which lines the saddle bracket and the frictionally resistant sliding pad atop the support bracket aid in dampening vibrations transmitted from the boom assembly to each linear actuator housing during operation of the apparatus. Secondly, each vibration dampening assembly restricts the pivotal movement of a linear actuator housing which is permitted by the pivot assembly. The pivotal movement of each linear actuator housing in one direction is limited by the space or gap between the linear actuator housing carried within the saddle bracket and the bottom surface of the support bracket. Pivotal movement of the linear actuator housing in a perpendicular direction is restricted by the limited sliding movement of the saddle bracket, sliding pad and retaining plate relative to the support bracket which is permitted by the mounting bolts, as described above.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
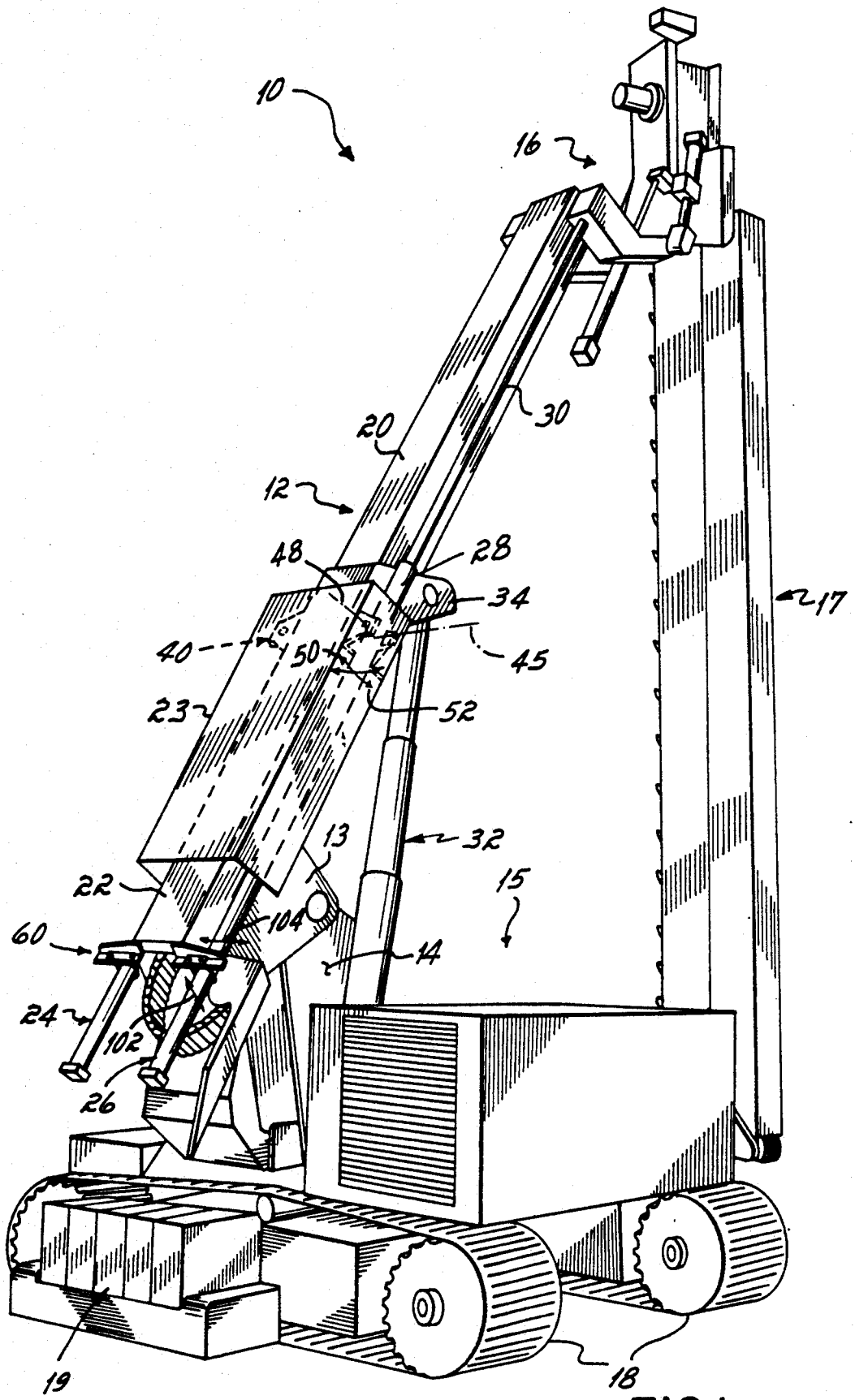
FIG. 1 is a perspective view of a trenching apparatus incorporating the boom assembly of this invention.

Referring to FIG. 1, the trenching apparatus 10 comprises a boom assembly 12 which is pivotally connected via a bracket 13 to a hinge 14 pivotally mounted (by means not shown) on a movable support base 15. The upper end of the boom assembly 12 carries a manipulator head 16 which pivotally mounts an elongated digger arm 17 operative to form a trench (not shown) in a manner such as disclosed in U.S. Pat. No. 4,843,742 to Camelleri. The support base 15 is drivingly connected to a pair of track assemblies 18 of the type employed in conventional bulldozers and other construction equipment. Counterweights 19 are attached to the side of the support base 15, opposite the digger arm 17, in order to stabilize the support base 15 against the cantilevered weight of the digger arm 17.

The boom assembly 12 includes an inner boom 20 having an upper end which pivotally mounts to the manipulator head 16, and a lower end which is slidably received within an outer boom 22. Preferably a shroud 23 is mounted over at least a portion of the outer boom 22. Telescopic movement of the inner boom 20 relative to the outer boom 22 is obtained by operation of a pair of linear actuators 24 and 26, such as pneumatic or hydraulic extension cylinders, located on either side of the inner and outer booms 20, 22. Each linear actuator 24 and 26 comprises an actuator housing 28 and an actuator rod 30. The actuator housing 28 of each linear actuator 24, 26 is mounted to the outer boom 22 as described in detail below, and the actuator rods 30 thereof are connected to the end of the inner boom 20. A lift cylinder 32 is pivotally connected by a bracket 34 to the outer boom 22 and is effective to angularly raise and lower the boom assembly 12 so that the digger arm 17 can be raised and lowered to perform a trenching operation. The foregoing construction of apparatus 10 forms no part of this invention of itself, and is therefore discussed only briefly herein for purposes of defining the overall construction of apparatus 10.

In the course of manipulating the digger arm 17, and while performing a trenching operation, bending forces and vibration are transmitted from the digger arm 17 and boom assembly 12 to the linear actuators 24, 26. Such bending forces and vibration can damage the actuator housing 28, the seals (not shown) within the actuator housing 28 and the actuator rod 30 of the linear actuators 24, 26. This invention is directed to the provision of a multi-directional pivot assembly 40, and a vibration dampening assembly 60, which mount the actuator housing 28 of each linear actuator 24, 26 to the outer boom 22 of the boom assembly 12 to substantially reduce damage to such linear actuators 24, 26. For purposes of the present discussion, the pivot assembly 40 and vibration dampening assembly 60 associated with linear actuator 26 are described herein. A separate pivot assembly 40 and vibration dampening assembly 60 are employed to mount the actuator housing 28 of actuator 24, and these assemblies 40, 60 are structurally and functionally identical to those associated with actuator 24.

Figures 2, 3, 4:
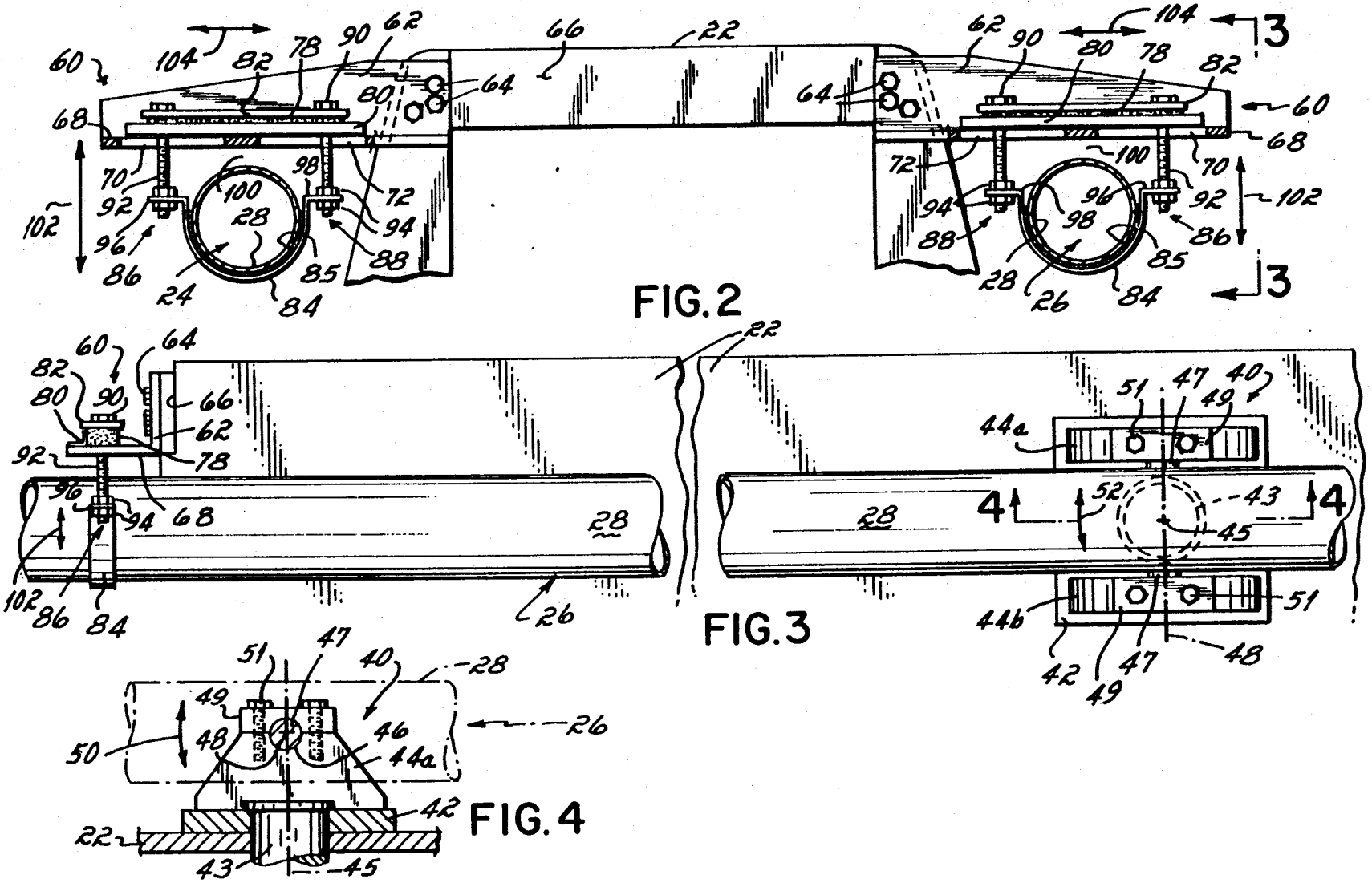
FIG. 2 is an end view, in partial cross section, of the boom assembly of FIG. 1.
FIG. 3 is a side view taken generally along line 3—3 of FIG. 2.
FIG. 4 is a schematic, cross-sectional view taken generally along line 4—4 of FIG. 3.

With reference to FIGS. 1, 3 and 4, the pivot assembly 40 has a clevis base 42 which is pivotally secured to the side of the outer boom 22 by a shaft 43 having a pivot axis 45. A pair of spaced side walls 44*a, b* project outwardly from the clevis base 42. The top of each side wall 44*a, b* is formed with a notch 46, each of which receive a journal 47 projecting outwardly from opposing sides of the actuator housing 28. The journals 47 have a common longitudinal axis 48 which passes through the actuator housing 28 and is oriented perpendicular to the pivot axis 45 of shaft 43. A clevis shackle 49 is connected by bolts 51 or other suitable fasteners over each journal 47, and into the top of each side wall 44, to prevent the journals 47 from being unseated from the notch 46 of clevis base 42.

The pivot assembly 40 permits pivotal motion of the cylinders 24, 26 in two perpendicular directions. The actuator housing 28 is pivotable about the common longitudinal axis 48 of the journals 47 in the direction indicated by arrow 50 depicted in FIGS. 1 and 4. Pivotal movement of actuator housing 28 in a perpendicular direction, as depicted by arrow 52 in FIGS. 1 and 3, is permitted along axis 45 by the shaft 43 of clevis base 42. It has been found that the bending forces imposed by the digger arm 17 are applied to the linear actuators 24, 26 generally along the direction of arrows 50, 52, and the pivotal movement permitted by pivot assembly 40 therealong allows the actuator housing 28 of each such cylinder 24, 26 to move at least to a limited extent in the direction of such forces to avoid damage which would otherwise result if the actuator housings 28 were held in a fixed position on the outer boom 22 while their actuator rods 26 moved with the inner boom 20 and manipulator head 16.

The vibration dampening assembly 60 comprises an L-shaped support bracket 62 which is mounted by bolts 64 to the rear surface 66 of the outer boom 22. The support bracket 62 cantilevers outwardly from the outer boom 22 as depicted in FIG. 2. In the presently preferred embodiment, a substantially horizontally oriented leg 68 of the L-shaped support bracket 62 is formed with a pair of elongated slots 70 and 72 each formed with opposed edges. A sliding pad 78, preferably formed of any suitable low friction, wear resistant material such as Nylatron, is carried atop the leg 68 of support bracket 62 over the elongated slots 70, 72. "Nylatron" is a registered trademark of The Polymer Company. The sliding pad 78 is positioned atop the support bracket leg 68 against an angle 80 fixed to the leg 68, and beneath a retaining plate 82. The sliding pad 78 and retaining plate 82 are formed with aligning bores (not shown) which, in turn, align with the elongated slots 70 and 72 formed in the support bracket leg 68.

In the presently preferred embodiment, a semicircular-shaped saddle bracket 84, preferably lined with a layer 85 of resilient, rubber-like cushioning material, is mounted beneath the support bracket 62 by a pair of bolts 86 and 88. The head 90 of each bolt rests atop the retaining plate 82 and the shaft 92 of such bolts 86, 88 extend through the bores in the retaining plate 82 and sliding pad 78, and then through the elongated slots 70 and 72 formed in the support bracket leg 68. The bottom of the threaded shank 92 of each bolt 86, 88 is mounted by nuts 94 to one of two flanges 96 and 98 formed at the top of saddle bracket 84.

The actuator housing 28 of each linear actuator 24, 26 rests atop the layer 85 of cushioning material in the saddle bracket 84 such that a space or gap 100 is formed between the upper portion of the actuator housing 28 and the bottom surface of the leg 68 of support bracket 62. This permits "up and down" movement of the actuator housing 28 relative to the support bracket 62, i.e., in the direction of arrow 102 in FIG. 2, to the extent of such space or gap 100. Additionally, with the actuator housing 28 in the position illustrated in FIG. 2, the bolts 86 and 88 are located substantially in the center of the slots 70 and 72 formed in the support bracket leg 68. The retaining plate 82, sliding pad 78, saddle bracket 84 and actuator housing 28 are all movable side-to-side relative to the support bracket 62, i.e., in the direction of the arrow 104 in FIG. 2, until the bolts 86 and 88 engage one of the opposed edges of the slots 70, 72 in the support bracket leg 68.

The vibration dampening assembly 60 performs two functions. First, in the course of a digging operation, vibrations are transferred from the digger arm 17 and boom assembly 12 to each of the linear actuators 24 and 26. These vibrations can create both wear of the seals within the actuator housings 28 leading to their premature failure and external damage to the actuator housing 28 which results in rupture in the housing or inability to operate the actuators 24 and 26. The resilient, cushioning layer 85 within the saddle brackets 84 which carry the actuators 24, 26 and the frictional loading of the sliding pads 78 at least partially dampens the vibrations transmitted from boom assembly 12 and therefore reduces internal and external damage to the actuators 24, 26 and their seals.

Another important feature of the vibration dampening assembly 60 is to limit the motion of the actuator housings 28 permitted by the pivot assemblies 40. As mentioned above, the pivot assemblies 40 allow the actuator housings 28 to move in the perpendicular directions depicted by arrows 50 and 52 in FIGS. 1, 3 and 4. Movement of the actuator housings 28 in the direction illustrated by arrow 50 creates a side-to-side movement along the L-shaped support bracket 62 at the vibration dampening assembly 60 as depicted by the arrow 104 in FIG. 2. The extent of this side-to-side motion is restricted by the mounting bolts 86 and 88 and the length of the elongated slots 70 and 72 in the support bracket legs 68. In response to the application of bending forces which cause the actuator housing 28 to move in this side-to-side direction, i.e., generally along arrow 104, the sliding pad 78 and retaining plate 82 move laterally atop the support bracket leg 68. Because the actuator housing 28 is carried by the saddle bracket 84 mounted to the retaining plate 82 and sliding pad 78, the actuator housing 28 also moves side-to-side. The extent of this movement is limited by engagement of one or both of the bolts 86, 88 with one of the opposed edges of the elongated slots 70, 72.

Movement of the actuator housings 28 is also restricted by the vibration dampening assembly 60 in the direction depicted by arrow 52 in FIGS. 1 and 3. Pivotal movement of the actuator housing 28 in the direction of arrow 52 results in a generally up and down movement at the dampening assembly 60, as viewed in FIG. 2, wherein the actuator housing 28 moves either toward or away from the support bracket leg 68. See arrow 102 in FIG. 2. The extent of this up and down movement is limited by tee space or gap 100 between the upper portion of the actuator housing 28 within saddle bracket 84 and the bottom surface of the support bracket leg 68. Engagement of the actuator housing 28 with the support bracket leg 68 prevents further upward movement thereof, and this gap 100 may be varied, as desired, by using bolts 86, 88 of differing length and/or by varying the position of saddle bracket 84 along the shank 92 of bolts 86, 88. While the side-to-side and up and down movement of the actuator housing of each linear actuator 24, 26 is limited by the vibration dampening assembly 60, such movement is sufficient to substantially prevent damage to the actuator housing 28 and/or actuator rods 30 in most trenching applications.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the term linear actuator has been used herein to refer to the mechanisms for extending and retracting the inner boom 20 with respect to the outer boom 22. It is contemplated that such linear actuators could be hydraulic cylinders, pneumatic cylinders or other functionally similar devices.

Therefore, it is intended that the invention not be limited to the particular embodiment disclosed as the best mode contemplated for carrying out this invention, but that the invention will include all embodiments falling within the scope of the appended claims.

What is claimed is:

1. An apparatus for digging a trench, comprising:

a support base movable along a trench line;

a digger arm for digging a trench along said trench line;

a manipulator head pivotally mounted to said digger arm;

a boom assembly including an inner boom slidable within an outer boom, said outer boom being pivotally mounted to said support base and said inner boom being connected to said manipulator head;

at least one linear actuator operative to move said inner boom in and out of said outer boom, said linear actuator having an actuator housing and an actuator rod connected to said inner boom; and pivot means for mounting said actuator housing of said linear actuator to said outer boom of said boom assembly to permit movement of said linear actuator about at least two mutually perpendicular axes.

2. The apparatus of claim 1 wherein said pivot means comprises:

a clevis mount having a base and opposed side walls extending from said base;

a pivot shaft connected at one end to said outer boom of said linear actuator and at the other end to said base of said clevis mount, said base being pivotal relative to said pivot shaft about the longitudinal axis of said pivot shaft;

a first journal and a second journal each projecting from opposite sides of said actuator housing of said linear actuator, said first and second journals having a common longitudinal axis; and means for securing each of said first and second journals to one of said opposed side walls of said clevis mount while permitting pivotal motion of said actuator housing of said linear actuator about said common longitudinal axis of said first and second journals.

3. An apparatus for digging a trench, comprising:

a support base movable along a trench line;

a digger arm for digging a trench along said trench line;

a manipulator head pivotally mounted to said digger arm;

a boom assembly including an inner boom slidable within an outer boom, said outer boom being pivotally mounted to said support base and said inner boom being connected to said manipulator head;

at least one linear actuator operative to move said inner boom in and out of said outer boom, said linear actuator having an actuator housing and an actuator rod connected to said inner boom; and vibration dampening means connected between said outer boom of said boom assembly and said actuator housing of said linear actuator for limiting the transmission of vibration therebetween.

4. The apparatus of claim 3 wherein said vibration dampening means comprises:

at least one support bracket attached to said outer boom;

at least one saddle bracket connected to said support bracket, said saddle bracket including a lining of resilient shock absorbing material which contacts and supports said actuator housing of said linear actuator.

5. The apparatus of claim 3 wherein said vibration dampening means comprises:

at least one support bracket attached to said outer boom;

a resilient pad carried by said support bracket;

at least one saddle bracket connected to said support bracket and to said resilient pad, said saddle bracket including a lining of resilient shock absorbing material which contacts and supports said actuator housing of said linear actuator.

6. An apparatus for digging a trench, comprising:

a support base movable along a trench line;

a digger arm for digging a trench along said trench line;

a manipulator head pivotally mounted to said digger arm;

a boom assembly including an inner boom slidable within an outer boom, said outer boom being pivotally mounted to said support base and said inner boom being connected to said manipulator head;

at least one linear actuator operative to move said inner boom in and out of said outer boom, said linear actuator having an actuator housing and an actuator rod communicating with said inner boom;

pivot means for mounting said actuator housing of said linear actuator to said outer boom of said boom assembly to permit movement of said linear actuator about at least two mutually perpendicular axes;

vibration dampening means connected between said outer boom of said boom assembly and said actuator housing of said linear actuator for limiting the transmission of vibration therebetween; and pivot stop means associated with said vibration dampening means for limiting the extent of pivotal movement of said linear actuator permitted by said pivot means about said two mutually perpendicular axes.

7. The apparatus of claim 6 in which said pivot means, comprises:

a clevis mount having a base and opposed side walls extending from said base;

a pivot shaft connected at one end to said outer boom of said linear actuator and at the other end to said base of said clevis mount, said base being pivotal relative to said pivot shaft about the longitudinal axis of said pivot shaft;

a first journal and a second journal each projecting from opposite sides of said actuator housing of said linear actuator, said first and second journals having a common longitudinal axis; and means for securing each of said first and second journals to one of said opposed side walls of said clevis mount while permitting pivotal motion of said actuator housing of said linear actuator about said common longitudinal axis of said first and second journals.

8. The apparatus of claim 6 wherein said vibration dampening means comprises:

at least one support bracket attached to said outer boom, said support bracket being formed with at least one elongated slot having opposed edges;

at least one saddle bracket connected to said support bracket, said saddle bracket including a lining of resilient shock absorbing material which contacts and supports said actuator housing of said linear actuator.

9. The apparatus of claim 6 wherein said vibration dampening means comprises:

at least one support bracket attached to said outer boom, said support bracket being formed with at least one elongated slot having opposed edges;

a resilient pad carried by said support bracket;

at least one saddle bracket connected to said support bracket and to said resilient pad, said saddle bracket including a lining of resilient shock absorbing material which contacts and supports said actuator housing of said linear actuator 10. The apparatus of claim 9 in which said resilient pad is formed with at least two bores which align with said at least one elongated slot formed in said support bracket, said pivot stop means comprising:

a pair of bolts connected between said resilient pad and said saddle bracket s that said bolts extend through said bores in said resilient pad and said at least one elongated slot in said support bracket, said bolts having a predetermined length so that said actuator housing of said linear actuator is carried within said saddle bracket a predetermined distance below said support bracket to control the extent of movement of said actuator housing in a first direction toward and away from said support bracket, said bolts being movable with said resilient pad along said support bracket and being engageable with said edges of said at least one elongated slot in said support bracket to control the extent of movement of said actuator housing in a second direction along said support bracket perpendicular to said first direction.

* * * * *